US006193149B1

(12) United States Patent
Hesoun

(10) Patent No.: US 6,193,149 B1
(45) Date of Patent: Feb. 27, 2001

(54) LOCKABLE CASSETTE FOR THE STORAGE OF VALUABLE DOCUMENTS OR VALUABLE ARTICLES

(75) Inventor: Peter Hesoun, Syrengatan (SE)

(73) Assignee: De la Rue Inter Innovation AB, Flen (SE)

( * ) Notice: Subject to any disclaimer, the term of this patent is extended or adjusted under 35 U.S.C. 154(b) by 0 days.

(21) Appl. No.: 08/694,278

(22) Filed: Aug. 8, 1996

(30) Foreign Application Priority Data

Aug. 9, 1995 (SE) ..... 9502791

(51) Int. Cl.[7] ..... B65D 91/00
(52) U.S. Cl. ..... 232/1 D
(58) Field of Search ..... 232/1 D, 15, 16, 232/7, 43.2; 109/50, 51, 52, 22, 23, 45, 66

(56) References Cited

U.S. PATENT DOCUMENTS 3,948,376 * 4/1976 Roman ..... 232/15 X
4,283,097 8/1981 Lundblad .
4,552,075 * 11/1985 Gasson et al. ..... 232/1 D X
4,597,340 * 7/1986 Huckle ..... 109/45
5,209,395 * 5/1993 Zouzoulas et al. ..... 232/1 D X
5,249,831 10/1993 Maniaci .

* cited by examiner

*Primary Examiner*—Jerry Redman
(74) *Attorney, Agent, or Firm*—Lathrop & Gage LC

(57) ABSTRACT

A lockable cassette (8) having a lid (10) is closed and locked when removed from a cassette casing but is released and unlocked when inserted into the casing by virtue of the actuation of an element (19, 25) which functions to move a lock bolt (18) from a lid-latching starting position to a lid release position. The element includes an electric relay (19) and a two-arm lever (25). A core (23) of the relay is attached to one arm (31) of the two-arm lever and is actuable by a first pressure spring (21), wherein the other arm (32) of the lever forms abutment surfaces or stop surfaces for the lock bolt in its lid latching position when the relay is inactive. The arrangement further includes a second pressure spring (27) which is attached to a counterweight (29) which, when the relay is inactive, lightly abuts, but is not fastened to, the other arm (32) of the two-arm lever for actuation of the lever in a direction opposite to the direction in which the core moves to allow the lock bolt to occupy the release position. The first pressure spring, the second pressure spring and the counterweight are configured to balance the mass of the relay core.

21 Claims, 3 Drawing Sheets

LOCKABLE CASSETTE FOR THE STORAGE OF VALUABLE DOCUMENTS OR VALUABLE ARTICLES

FIELD OF THE INVENTION

The present invention relates to a lockable cassette or the like intended for the storage of valuable documents and articles.

DESCRIPTION OF THE RELATED ART

It is generally preferred that cassette locking mechanisms of the aforedescribed kind be secure against unauthorized access to the cassette, e.g., by impact forces or by pivotal or rotational movement.

It is known in the art, e.g., from U.S. Pat. No. 5,249,831, to provide a lock provided with a lock bolt that is connected to a counterweight via a pivotally mounted lever. The lengths of the two arms of the lever and the masses of the respective lock bolt and counterweight are selected so that, in the event of an essentially horizontal impact, the mass of the bolt and the mass of the counterweight will counteract each other so as to render the lock unforcible when such manipulations are attempted. However, if an attempt is made to manipulate the lock by rotation, the mass of the counterweight would, instead, amplify the imbalance, thereby impairing the desired protection against manipulation of the lock.

What is needed is a system for the storage of valuable documents and articles including a cassette and a casing for removably receiving the cassette, wherein the cassette is closed and locked when removed from the casing but is unlocked and accessible when inserted into the casing and wherein a locking mechanism of the cassette is configured to prevent unauthorized entry therein by striking or rotating the cassette.

SUMMARY OF THE INVENTION

An improved lockable cassette system is provided for the storage of valuable documents and articles. The system includes a cassette having a lid, wherein the cassette is closed and locked when removed from a cassette casing but is unlocked and accessible when inserted into the casing by virtue of an actuation of a means which functions to move a lock bolt between a lid-latching position and a lid release position, wherein the means is comprised of an electric relay and a two-arm lever, with one arm of the two-arm lever attached to the core of the relay that is actuatable to a locking position by a first pressure spring, and with the other arm of the two-arm lever forming a surface for establishing an abutting relationship with the lock bolt in its lid-latching position as the relay is inactive.

The system also includes a counterweight attached to the pressure spring wherein, when the relay is inactive, the counterweight has a light resilient abutting relationship with, but is not fastened to, one arm of a lever so as to actuate the lever in a direction opposite to the direction of movement of the core of the relay in order to allow the lock bolt to occupy a non-locking position. The pressure spring and the mass of the counterweight are configured to solely balance-out the mass of the relay core.

Objects and advantages of the present invention include: providing a lockable cassette system for the storage of valuable documents and articles wherein protection is provided against unauthorized access to the contents of a cassette thereof by applying impact forces to the cassette; providing such a cassette system wherein protection is provided against unauthorized access to the contents of a cassette thereof by applying rotational forces to the cassette; and generally providing such a cassette system that is economical to manufacture, efficient in operation, reliable in performance, capable of long operating life and particularly well adapted for the proposed usage thereof.

Other objects and advantages of the present invention will become apparent from the following description taken in conjunction with the accompanying drawings, which constitute a part of this specification and wherein are set forth exemplary embodiments of the present invention to illustrate various objects and features thereof.

BRIEF DESCRIPTION OF THE DRAWINGS

The invention will now be described in more detail with reference to the accompanying drawings, in which.

DESCRIPTION OF A PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
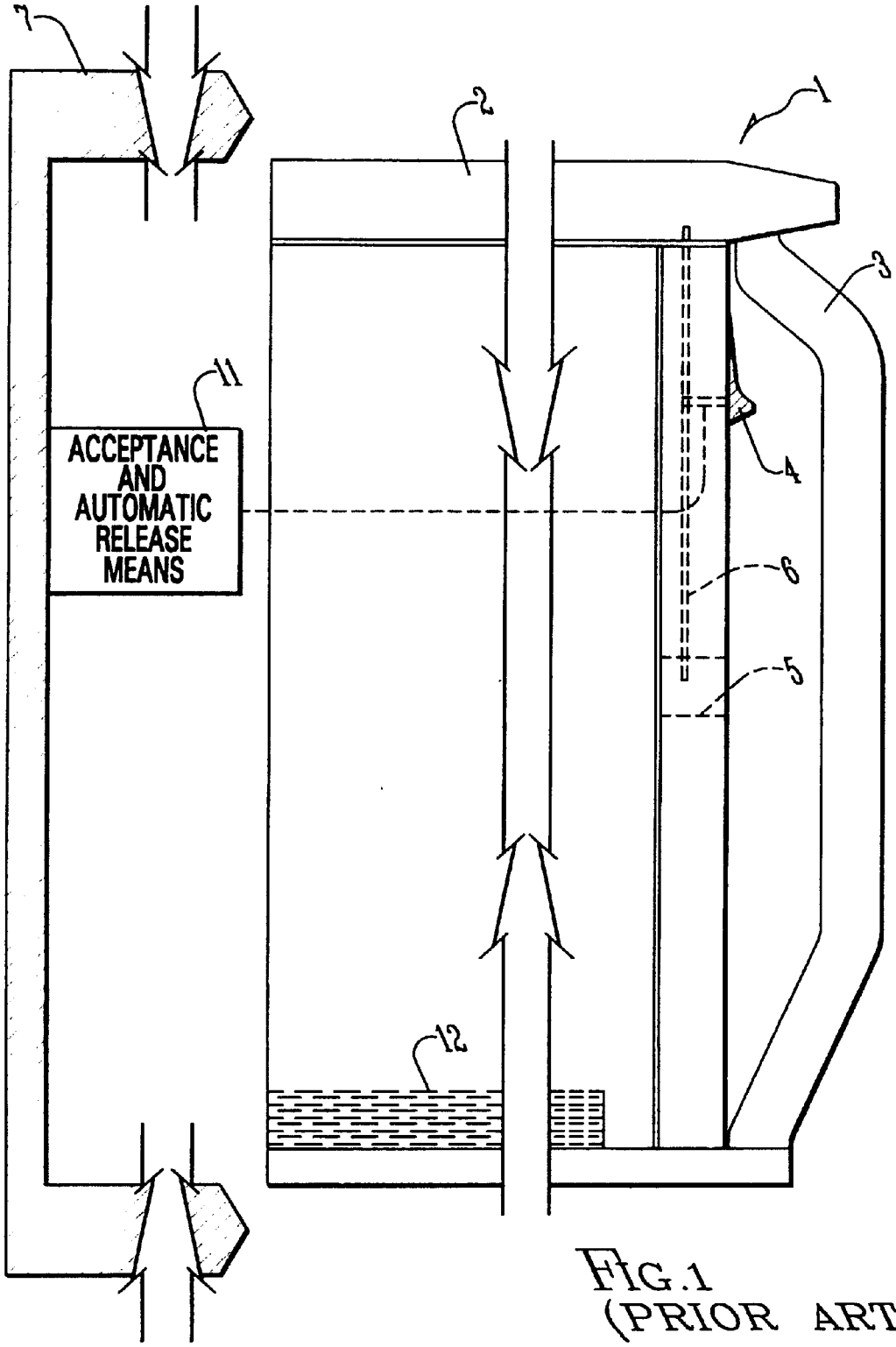
FIG. 1 (PRIOR ART)
FIG. 1 is a fragmentary and schematic, side elevational view of a prior art lockable cassette.
Figure 2:
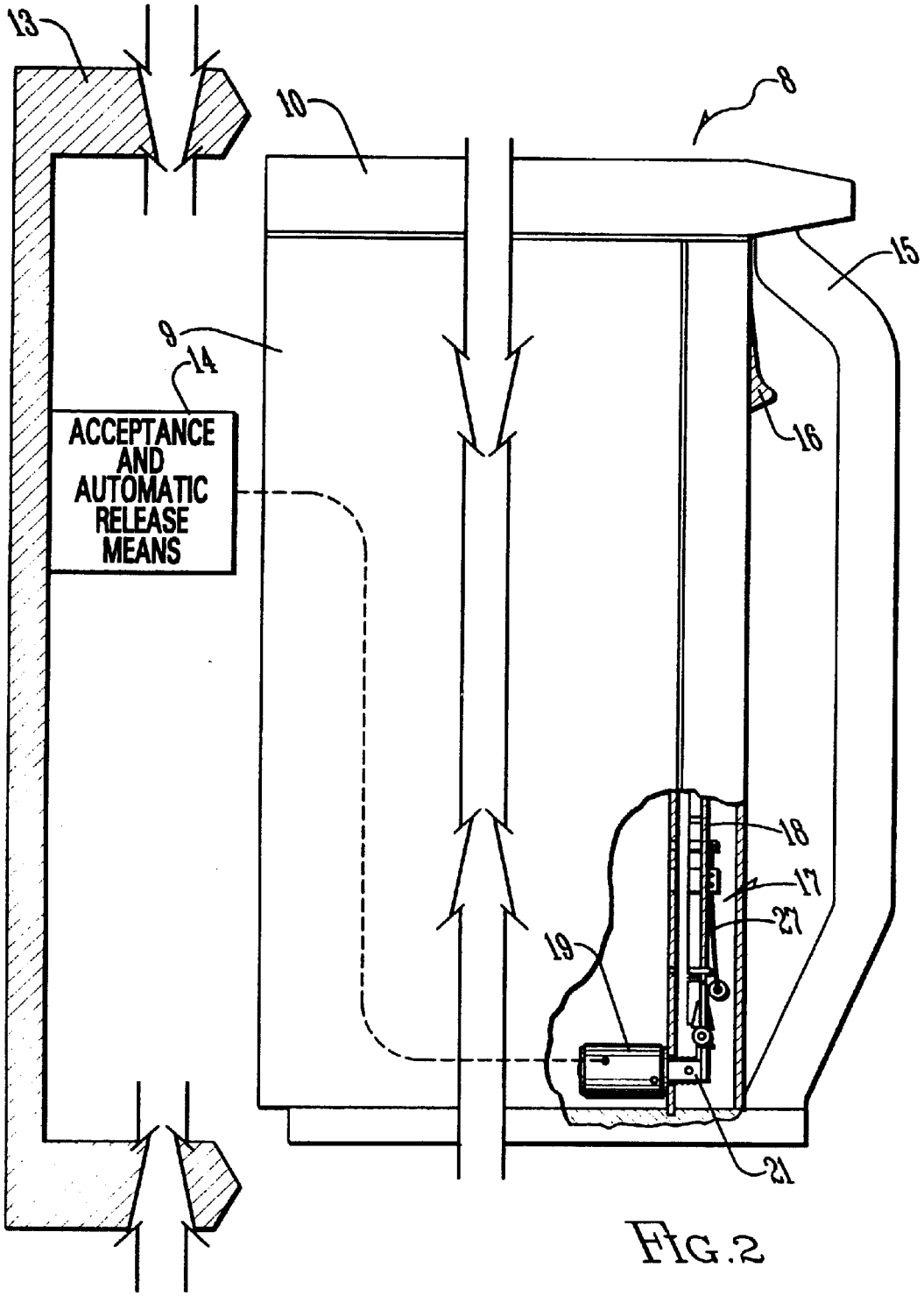
FIG. 2 is a fragmentary and schematic, side elevational view of a lockable cassette system for the storage of valuable documents and articles, with portions cut away to reveal details thereof, in accordance with the present invention.

A prior art lockable cassette, as shown in FIG. 1, generally includes a cassette 1 having a lid 2, a handle 3, a release button 4, and a lock mechanism 5. In FIG. 1, the cassette 1 is shown removed from its casing 7 and, hence, the lid 2 is locked by the lock mechanism 5. When the cassette 1 is inserted into its casing 7 and accepted through mechanical or electrical means, schematically shown as acceptance and automatic release means 11 in FIG. 1, for dispensing or receiving banknotes, for instance, a lock bolt 6 of the lock mechanism 5 is automatically released so that the button 4 can be depressed and the lid 2 moved to one side, such as horizontally to the right in FIG. 1. The interior of the cassette 1 is then accessible for the automatic infeed or outfeed of documents 12. A cassette of this kind is taught by U.S. Pat. No. 4,283,097, for instance.

The reference numeral 8 generally refers to a lockable cassette system for the storage of valuable documents and articles 12 in accordance with the present invention, as shown in FIGS. 2 through 5. The system 8 includes a cassette 9 having a lid 10, a handle 15, a button means 16, and a lock mechanism 17. The cassette 9 is shown removed from its casing 13 and hence the lid 10 is locked by the lock mechanism 17, as will be described in more detail below. When the cassette 9 is inserted into its casing 13 and accepted through mechanical or electrical means, schematically shown as acceptance and automatic release means 14 in FIG. 2, for dispensing or receiving banknotes, for instance, a lock bolt 18 of the lock mechanism 17 is automatically released so that the button 16 can be depressed and the lid 10 moved to one side, such as to the right in FIG. 2. The interior of the cassette 9 is then accessible for the automatic infeed or outfeed of documents.

Figure 3:
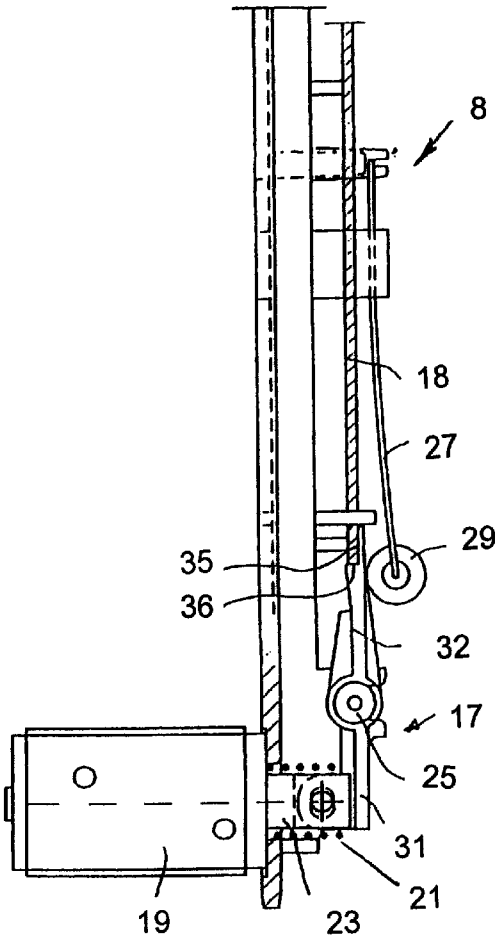
FIG. 3 is an enlarged and fragmentary, side elevational view of the lockable cassette system, showing a lock mechanism thereof in a locked state.

The lock mechanism 17 shown in FIG. 3 includes a relay 19 such as a magnet on solenoid type or other suitable device, an actuator spring 21 which surrounds a core 23 of the relay 19, a two-arm lever 25, the lock bolt 18 and a pressure spring 27 such as a wire spring or other suitable device, and a counterweight 29. The core 23 of the relay 19 is pivotally attached to a bottom arm 31 of the lever 25, an upper arm 32 of the lever 25 having abutment surfaces 35, 36 for establishing an abutting relationship with the lock bolt 18 as the lock mechanism 17 assumes a latched position and the relay 19 is inactive, as shown in FIG. 3. In other words, as the relay 19 is inactive, i.e., without current flow, the lever 25 assumes the illustrated position and the lock bolt 18 is prevented from downward movement relative to the upper arm 32 and an upper end of the lock bolt 18 acts as a latch for the lid 10, thereby preventing the lid 10 from being opened without force.

The pressure spring 27 bears lightly against the upper arm 32 via the counterweight 29 as the relay 19 is inactive. If the cassette 9 were to be manipulated by rotating the cassette 9 with the intention of applying mass forces to the relay core 23 such that the core 23 would tend to move to the left as shown in FIG. 3, such tendency would be counteracted by the actuator spring 21 that surrounds the core 23. As the counterweight 29 is unable to urge the arm 32 inwardly, such as to the left in FIG. 3, because of the forces that result from rotating the cassette 9, such as counterclockwise as shown in FIG. 3, the actuator spring 21 need only balance the core 23 of the relay 19. This feature of the present invention increases security against manipulation for the relay 19 of selected size.

If the cassette 9 were to be struck with the intention of causing the relay core 23 to retract inwardly, such as an impact to the right in an attempt to cause the core 23 to be displaced toward the left in FIG. 3 relative to the cassette 9, and thereby cause the core 23 to pull on the two-arm lever 25 such that the two-arm lever 25 would tend to rotate clockwise as shown in FIG. 3, such impact would be counteracted by the counterweight 29 in coaction with the actuator spring 21 and the pressure spring 27.

Figure 4:
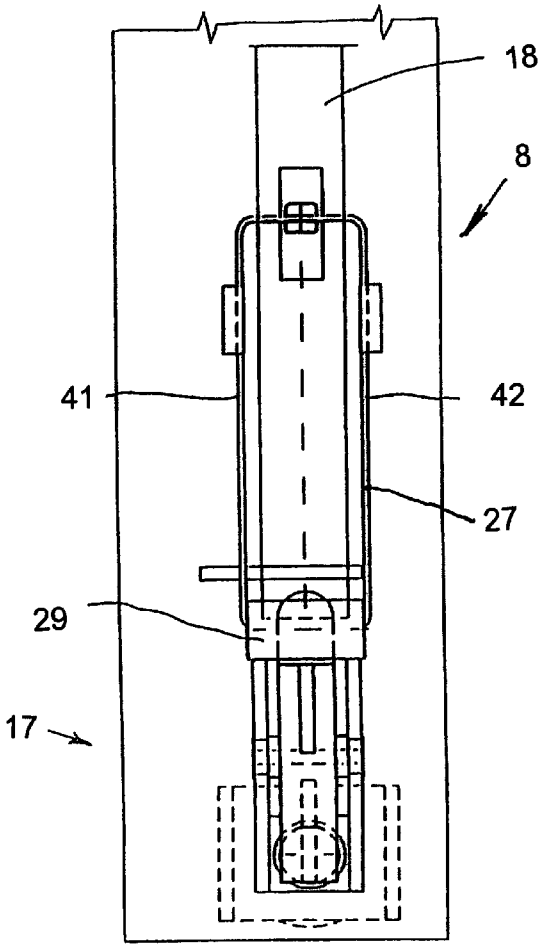
FIG. 4 is an enlarged and fragmentary view of the lockable cassette system, showing a front elevational view of the lock mechanism shown in FIG. 3.

As shown in FIG. 4, the pressure spring 27 is a wire spring having two legs 41, 42 which, together, hold the counterweight 29.

Figure 5:
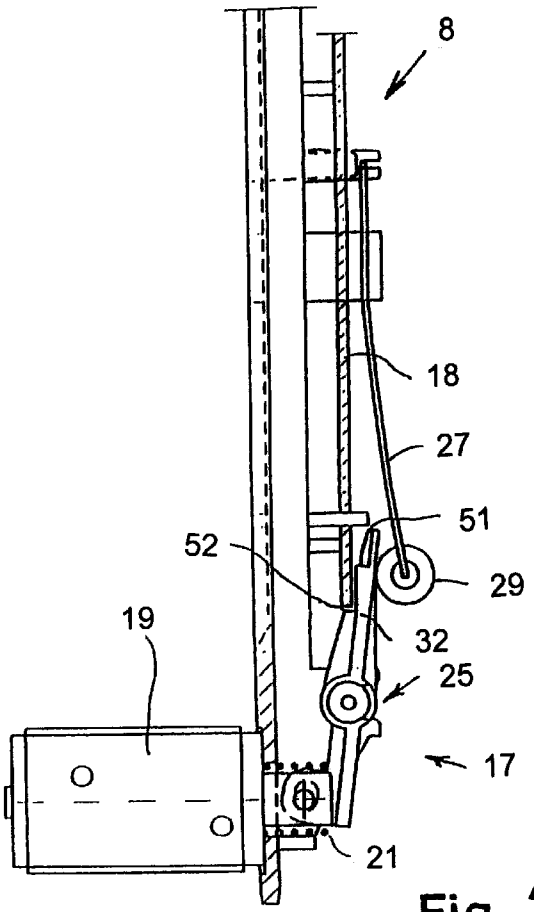
FIG. 5 is an enlarged and fragmentary, side elevational view of the lockable cassette system, similar to that shown in FIG. 3 but showing the lock mechanism in a released or unlocked state, according to the present invention.

FIG. 5 shows the relay 19 in an active state and the lever 25 rotated clockwise so as to enable the lock bolt 18 to leave an upper shoulder 51 of the upper arm 32 and be pulled downwardly by the button 16 to a lower shoulder 52 of the upper arm 32, thereby placing the lid 10 in a released or unlocked state.

It is to be understood that while certain forms of the present invention have been illustrated and described herein, it is not to be limited to the specific forms or arrangement of parts described and shown.

What is claimed and desired to be secured by Letters Patent is as follows:

1. A lockable cassette including a lid, a lock bolt having a lid-latching position wherein the cassette is closed and locked and a lid release position wherein the cassette is unlocked and openable, and an electric relay configured to operatively move the lock bolt from the lid-latching position to the lid release position, said electric relay comprises a relay core and a two-arm lever having a locking position, wherein the relay core is attached to one arm of the two-arm lever and is structured to be actuable to the locking position by a first pressure spring, and wherein the other arm of said two-arm lever includes an abutment surface for the lock bolt in the lid-latching position when the relay is inactive, the actuation means being characterized by a second pressure spring having attached thereto a counterweight which, when the relay is inactive, lightly abuts said other arm of the two-arm lever for actuation of the two-arm lever in a direction opposite to that in which the relay core moves to allow the lock bolt to occupy said lid release position, and being further characterized in that the first pressure spring, the second pressure spring and the counterweight are dimensioned to operatively balance the relay core.

2. A cassette having a lid, the cassette comprising:

(a) a lock including a lock bolt having a retracted configuration defining a lid-releasing configuration and an extended position defining a lid-latching configuration; and (b) an anti-manipulation system comprising a lever arrangement having a secure configuration wherein said lock bolt is prevented from assuming said retracted position from said extended configuration and an unsecure configuration wherein said lock bolt assumes a retracted configuration, said lever arrangement comprising a lever having an upper arm, a lower arm, and a resilient member operably configured to apply a biasing force to said upper arm of said lever to oppose displacement of said lever from a secure configuration to an unsecure configuration.

3. The system according to claim 2, wherein said lever arrangement includes an upper arm having an upper shoulder configured to receive said lock bolt in abutting engagement as said lock bolt assumes said extended configuration and having a lower shoulder configured to receive said lock bolt in abutting engagement as said lock bolt assumes said retracted configuration.

4. The system according to claim 2, including activation means for displacing said lever arrangement from said secure configuration to said unsecure configuration as said activation means assumes an active state thereof and for not displacing said lever arrangement from said secure configuration to said unsecure configuration as said activation means assumes an inactive state thereof.

5. The system according to claim 4, wherein said anti-manipulation means further includes resilient means for preventing displacement of said lever arrangement from said secure configuration to said unsecure configuration as said activation means assumes said inactive state and said lock bolt assumes said extended configuration.

6. The system according to claim 5, wherein said resilient means includes a resilient member configured to apply a biasing force to said lever arrangement wherein said biasing force opposes displacement of said lever arrangement from said secure configuration to said unsecure configuration.

7. The system according to claim 5, wherein said resilient means includes a resilient member and a counterweight mounted on said resilient member such that a biasing force, cooperatively applied to said lever arrangement, opposes displacement of said lever arrangement from said secure configuration to said unsecure configuration.

8. The system according to claim 7, wherein said resilient member is a wire spring.

9. The system according to claim 5, wherein said resilient means is configured to apply a moment to said lever arrangement, said moment having a magnitude at least as great as a countermoment applied to said lever arrangement wherein said countermoment arises from inertial forces created by a striking of the cassette in an attempt to obtain unauthorized entry into the cassette.

10. The system according to claim 5, wherein said resilient means is configured to apply a moment to said lever arrangement, said moment having a magnitude at least as great as a countermoment applied to said lever arrangement wherein said countermoment arises from inertial forces created by rotating the cassette in an attempt to obtain unauthorized entry into the cassette.

11. The system according to claim 4, wherein said activation means includes an electric relay having a core that is extended as said activation means assumes said inactive state and said lock bolt assumes said extended configuration, and is retracted as said activation means assumes said active state.

12. The system according to claim 11, wherein said anti-manipulation means further includes resilient means for preventing displacement of said lever arrangement from said secure configuration to said unsecure configuration as said activation means assumes said inactive state and said lock bolt assumes said extended configuration.

13. The system according to claim 12, wherein said resilient means includes a resilient member configured to apply a biasing force to said lever arrangement wherein said biasing force opposes displacement of said lever arrangement from said secure configuration to said unsecure configuration.

14. The system according to claim 12, wherein said resilient means is configured to apply a moment to said lever arrangement, said moment having a magnitude at least as great as a countermoment applied to said lever arrangement wherein said countermoment arises from inertial forces created by a striking of the cassette in an attempt to obtain unauthorized entry into the cassette.

15. The system according to claim 12, wherein said resilient means is configured to apply a moment to said lever arrangement, said moment having a magnitude at least as great as a countermoment applied to said lever arrangement wherein said countermoment arises from inertial forces created by rotating the cassette in an attempt to obtain unauthorized entry into the cassette.

16. The system according to claim 12, wherein said resilient means includes a resilient member and a counterweight mounted on said resilient member such that a biasing force, cooperatively applied to said lever arrangement, opposes displacement of said lever arrangement from said secure configuration to said unsecure configuration.

17. The system according to claim 16, wherein said resilient member is a wire spring.

18. The system according to claim 16, including a relay resilient element configured to return said core from being retracted to being extended as said activation means assumes said inactive state from said active state, wherein said resilient member and counterweight and said relay resilient element are configured to apply moments to said lever arrangement, said moments cooperatively having a magnitude at least as great as a countermoment applied to said lever arrangement wherein said countermoment arises from inertial forces created by a striking of the cassette in an attempt to obtain unauthorized entry into the cassette.

19. The system according to claim 16, including a relay resilient element configured to return said core from being retracted to being extended as said activation means assumes said inactive state from said active state, wherein said resilient member and counterweight and said relay resilient element are configured to apply moments to said lever arrangement, said moments cooperatively having a magnitude at least as great as a countermoment applied to said lever arrangement wherein said countermoment arises from inertial forces created by rotating the cassette in an attempt to obtain unauthorized entry into the cassette.

20. A cassette having a lid, the cassette comprising:

(a) locking means having a lid-latching configuration and a lid-releasing configuration; said locking means including a lock bolt having a retracted configuration as said locking means assumes said lid-releasing configuration and an extended configuration as said locking means assumes said lid-latching configuration;

(b) anti-manipulation means, cooperative with said locking means, configured to operatively prevent unauthorized entry into the cassette by physically manipulating the cassette; said anti-manipulation means including:

(1) a lever arrangement having a secure configuration wherein said lock bolt is prevented from assuming said retracted configuration from said extended configuration and an unsecure configuration wherein said lock bolt is not prevented from assuming either of said retracted and extended configurations from the other of said extended and retracted configurations, and (2) resilient means configured to operatively prevent displacement of said lever arrangement from said secure configuration to said unsecure configuration as said activation means assumes said inactive state and said lock bolt assumes said extended configuration; and (c) activation means configured to operatively displace said lever arrangement from said secure configuration to said unsecure configuration as said activation means assumes an active state thereof and to not displace said lever arrangement from said secure configuration to said unsecure configuration as said activation means assumes an inactive state thereof.

21. A cassette having a lid, the cassette comprising:

(a) locking means having a lid-latching configuration and a lid-releasing configuration; said locking means including a lock bolt having a retracted configuration as said locking means assumes said lid-releasing configuration and an extended configuration as said locking means assumes said lid-latching configuration;

(b) anti-manipulation means, cooperative with said locking means, configured to operatively prevent unauthorized entry into the cassette by physically manipulating the cassette; said anti-manipulation means including a lever arrangement having a secure configuration wherein said lock bolt is prevented from assuming said retracted configuration from said extended configuration and an unsecure configuration wherein said lock bolt is not prevented from assuming either of said retracted and extended configurations from the other of said extended and retracted configurations; and (c) activation means configured to operatively displace said lever arrangement from said secure configuration to said unsecure configuration as said activation means assumes an active state thereof and to not displace said lever arrangement from said secure configuration to said unsecure configuration as said activation means assumes an inactive state thereof; said activation means including an electric relay having a core that is extended as said activation means assumes said inactive state and said lock bolt assumes said extended configuration, and is retracted as said activation means assumes said active state.

* * * * *